United States Patent [19]

Adiwinata

[11] Patent Number: 5,024,590

[45] Date of Patent: Jun. 18, 1991

[54] ROTARY ENGINE OF THE TYPE HAVING A PLANETARY ROTOR WITH ROTOR AND SHAFT EQUAL ROTATION

[76] Inventor: Sofyan Adiwinata, Jalan Kebalan VII No. 3, Kebayoran Baru, Jakarta, Indonesia

[21] Appl. No.: 349,873

[22] Filed: May 9, 1989

Related U.S. Application Data

[63] Continuation of Ser. No. 98,189, Sep. 17, 1987, abandoned.

[30] Foreign Application Priority Data

Sep. 18, 1986 [EP] European Pat. Off. ..... 86201617.7

[51] Int. Cl.[5] ..... F01C 1/22; F01C 17/02

[52] U.S. Cl. ..... 418/61.2

[58] Field of Search ..... 123/242; 418/61.2

[56] References Cited

U.S. PATENT DOCUMENTS

| | | | |
|---|---|---|---|
| 3,125,996 | 3/1964 | Höschele . | |
| 3,208,666 | 9/1965 | Fezer et al. | 418/61 A |
| 3,268,156 | 8/1966 | Radziwill et al. | 418/61 A |
| 3,699,929 | 10/1972 | Bennethum . | |
| 3,754,535 | 8/1973 | Hofbauer . | |
| 3,754,536 | 8/1973 | Fleming . | |
| 3,800,760 | 4/1974 | Knee . | |
| 3,875,905 | 4/1975 | Duquette . | |
| 3,913,408 | 10/1975 | Moore | 418/54 |
| 3,916,845 | 11/1975 | Klomp . | |
| 4,072,131 | 2/1978 | Pentel . | |
| 4,382,755 | 5/1983 | Hoffmann | 418/61.2 |

FOREIGN PATENT DOCUMENTS

| | | | |
|---|---|---|---|
| 1115267 | 10/1961 | Fed. Rep. of Germany . | |
| 1158752 | 12/1963 | Fed. Rep. of Germany . | |
| 1426024 | 5/1969 | Fed. Rep. of Germany | 418/61 A |
| 2095334 | 9/1982 | United Kingdom . | |

*Primary Examiner*—John J. Vrablik

*Attorney, Agent, or Firm*—Antonelli, Terry, Stout & Kraus

[57] ABSTRACT

A rotary engine, such as a rotary internal combustion engine, a rotary pump, a rotary compressor or the like, comprises a housing defining a cavity with a n-lobed epitrochoidal shaped wall, a n+1 lobed rotor within said cavity and movable in a planetary fashion, n being 1,2,3. . . and a main crank shaft with an eccentric supporting said rotor. The engine further comprises a transmission installed between the rotor and the main crank shaft, the transmission ratio of which being based on a certain ratio between the rotation of the rotor and the rotation of the main crank shaft such that during rotation of the rotor the shape of the outer envelope of the rotating rotor is exactly the same as the shape of the wall of the cavity.

4 Claims, 9 Drawing Sheets

ROTARY ENGINE OF THE TYPE HAVING A PLANETARY ROTOR WITH ROTOR AND SHAFT EQUAL ROTATION

This application is a continuation of application Ser. No. 098,189, filed Sept. 17, 1987, abandoned.

BACKGROUND OF THE INVENTION

The invention relates to a rotary engine, such as a rotary internal combustion engine, a rotary pump, a rotary compressor or the like, comprising a housing defining a cavity, a rotor within said cavity and movable in a planetary fashion and a main crank shaft with an eccentric supporting said rotor.

Rotary engines of the above mentioned type comprise an outer component having axially spaced end walls and a peripheral wall parallel to the axis and an inner component having axially spaced end surfaces and a peripheral wall parallel to the axis, which components hereafter will be reffered to as the housing and the rotor. The housing defines a cavity with a 1-, 2- or 3-lobed epitrochoidal shaped wall, within which a 2-, 3- or 4- respectively lobed rotor rotates in a planetary fashion.

When the rotary engine is a rotary internal combustion engine, the performance during use or operation will mostly be dependent on the strength of the wall of the cavity against the strong pressures of the rotor which receives the powerful impact caused by the expanding gases soon after the ignition/combustion. Such strong pressures of the rotor against the cavity wall are necessary in order to transmit the power to the main crank shaft of said engine.

Sooner or later such condition will cause an excessively heavy wear along the contact lines between the cavity wall and the rotor. In the end such excessively heavy wear will of course shorten the life or durability of said engines.

SUMMARY OF THE INVENTION

An object of the present invention is to provide a new system for transmitting said above mentioned impact power of the expanding gases directly to the main crank shaft, such that the transmission of the impact power is not dependent on the strength of the cavity wall, but dependent on equal rotation between the rotor and the main crank shaft, in order to remove the disadvantage of excessively heavy wear between the rotor and the cavity wall resulting from the impact of the rotor on the cavity wall caused by the expanding gases soon after every ignition or combustion.

This object is achieved by providing an engine comprising a transmission installed between the rotor and the main crank shaft, the transmission ratio of which is based on a certain ratio between the rotation of the rotor and the rotation of the main crank shaft such that during rotation of the rotor the shape of the outer envelope of the rotating rotor is exactly the same as the shape of the wall of the cavity.

As a result of this the power is directly transmitted from the rotor to the main crank shaft or vice versa through the transmission installed between the rotor and the main crank shaft. The transmission also acts as an accelerator or decelerator in order to maintain the shape of the outer envelope of the rotor the same as the epitrochoidal shape of the cavity wall while maintaining a permanent clearance between the rotor and the cavity wall during all stages of the rotation.

In a preferred embodiment of the rotary engine of the invention the rotor is provided with an internal involute gear meshing with an internal involute gear pinion supported by the main crank shaft and the transmission ratio of the transmission between the rotor and the main crank shaft is based on the formula $$\frac{IIGP}{IIG} - \frac{a}{b} = p$$

in which: IIGP refers to the pitch diameter of the internal involute gear pinion, IIG refers to the pitch diameter of the internal involute gear, a/b designates the additional rotation of the internal involute gear on each rotation of the main crank shaft, and p s the basic ratio for the specific type of rotary engine being $\frac{1}{2}$, $\frac{2}{3}$, $\frac{3}{4}$, . . . for a 1-, 2-, 3-, . . . respectively lobed epitrochoidal shaped cavity wall, such that during rotation of the rotor the shape of the outer envelope of the rotating rotor is exactly the same as the shape of the wall of the cavity.

In a further preferred embodiment of the rotary engine of the invention the eccentric for holding the rotor and driving or moving it eccentrically is made integral with the main crank shaft.

In another preferred embodiment the internal involute gear is fixed to or precasted on the rotor on one side or both sides of the rotor.

In another preferred embodiment of the engine the internal involute gear pinion is made integral with one of the gears of the transmission. Both gears may be mounted on a common hollow shaft provided with a proper needle bearing for the purpose of installing it to the main crank shaft.

In order to avoid direct contact between the rotor and the cavity wall particularly during compression and combustion stages in the case of a rotary internal combustion engine a proper clearence is permanently maintained between the rotor and the wall of the cavity in which a proper sealing system is installed.

In order to obtain a maximum utilization of the space available and minimum gears to be installed the rotary engine according to the invention is preferably constructed such that when the cavity has a 1-, 2- and 3-lobed epitrochoidal shaped wall and the rotor within said cavity has 2, 3 and 4 respectively lobes, a/b is equal to 1/6, 1/12 and 1/20 respectively, which means that on each rotation of the main crank shaft the internal involute gear and thus the rotor makes an additional, 1/6, 1/12 and 1/20 respectively rotation in the same direction, the internal involute gear pinion rotating in the same direction as the main crank shaft.

Further objects and features of the present invention will be apparent from the following description of a preferred embodiment with reference to the drawings attached to the application.

DETAILED DESCRIPTION OF THE PREFERRED EMBODIMENT

Figure 1:
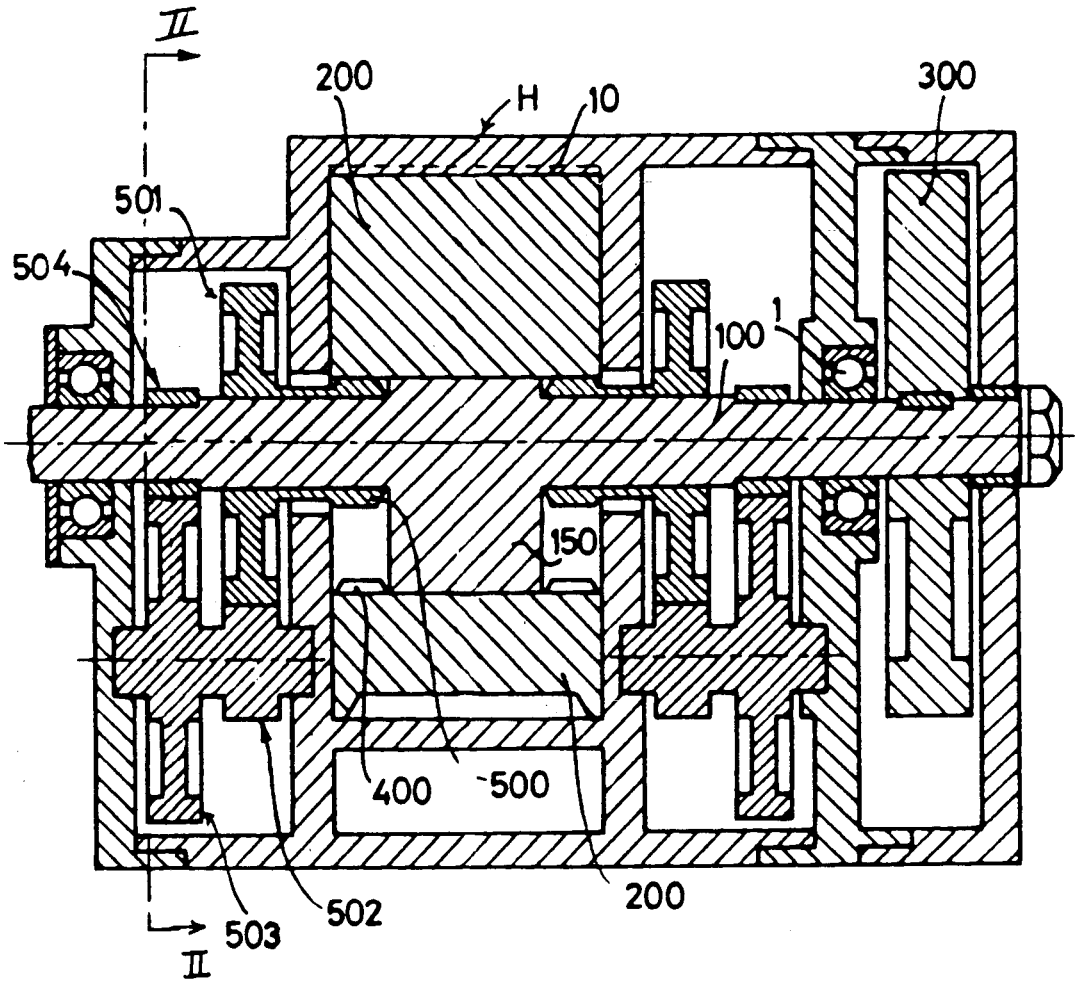
FIG. 1 is a view partly in longitudinal section and partly in elevation through the axis of one form of a rotary engine with a 2-lobed epitrochoidal cavity wall and a 3-lobed rotor.
Figure 2:
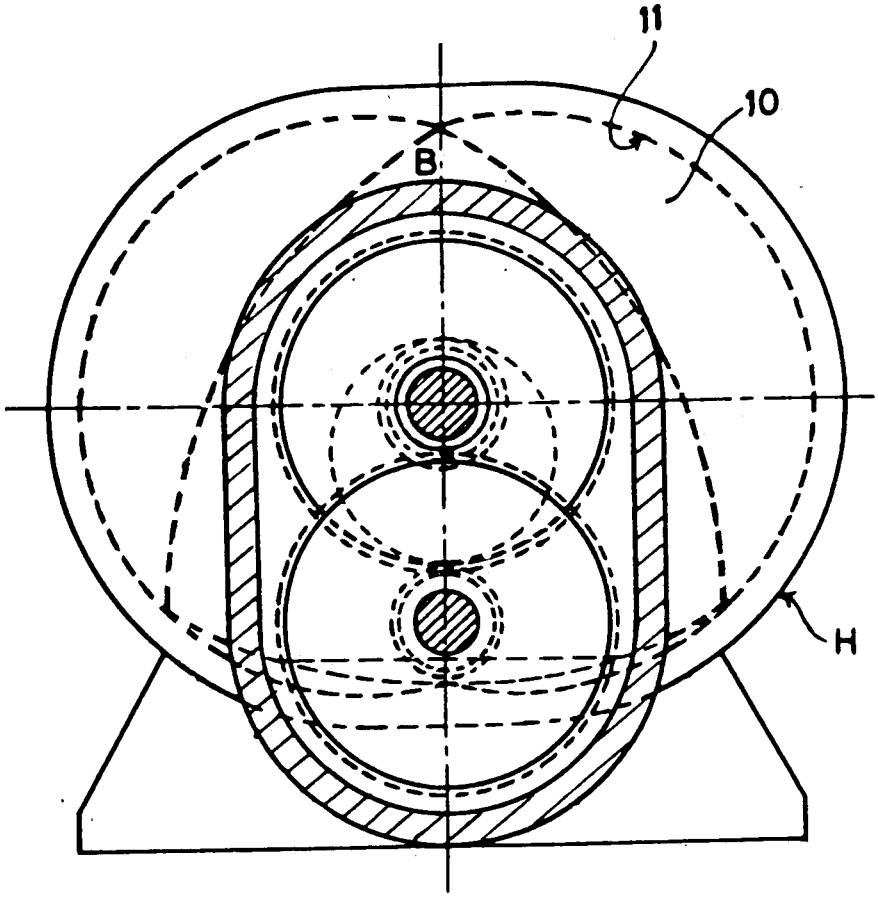
FIG. 2 is a cross sectional view taken along the line II—II of FIG. 1.
Figure 3:
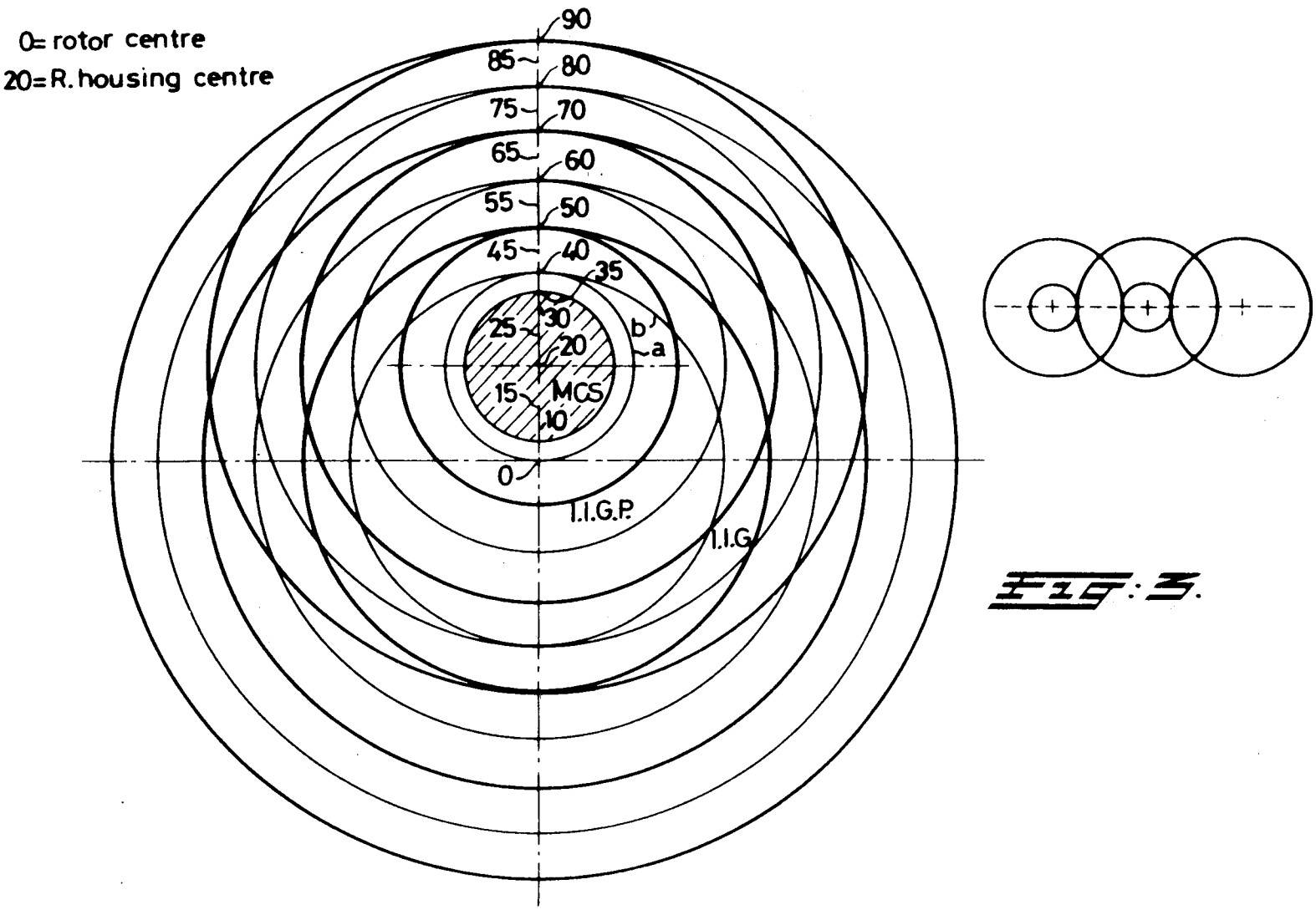
FIG. 3 shows various combinations of the internal involute gear and its pinion which are suitable for the rotary engine according to the present invention.

The rotary engine shown in FIG. 1 comprises a housing H which is stationary and which is supported by any suitable means which are not shown in the drawing.

The housing defines a cavity 10 with a 2-lobed epitrochoidal shaped wall 11. The 3-lobed rotor is rotatably mounted in the cavity 10. The rotor 200 is supported by an eccentric 150 which is part of the main crank shaft 100 of the engine. The main crank shaft is supported in the housing H by means of bearings 1 which can be combined with sealing elements. The main crank shaft 100 further carries a counter balancing wheel 300 and intermeshing gears which comprise an involute gear 501 with a hollow shaft which is made integral and combined with a pinion 500 for the purpose of rotating the internal involute gear 400 which is fixed to or precasted on the rotor 200 on one side or both sides of said rotor. The pinion 500 will further be referred to as the internal involute gear pinion.

The gear 501 intermeshes with a gear 502, which is combined on one shaft with a gear 503 which is driven or rotated by a gear 504 which is mounted directly on the main crank shaft 100 and fixed to said shaft.

Therefore any movement made by the gear 504 will directly and automatically rotate the rotor 200 and vice versa. By the proper choice of the transmission ratio of the transmission between the main crank shaft 100 and the internal involute gear 400 it is possible maintain permanently the proper shape of the outer envelope of the rotating rotor which is exactly the same as the shape of the 2-lobed epitrochoidal cavity wall 11.

This is necessary in order to maintain the proper clearence between the rotor and the cavity wall for installing a sealing system. Furthermore, the rotor which receives the impact power after every ignition/-combustion will transmit the power directly to the main crank shaft without causing excessive wear of the cavity wall.

This can only be achieved when the transmission ratio of the transmission between the main crank shaft and the rotor is based on the following formula $$\frac{IIGP}{IIG} - \frac{a}{b} = \frac{2}{3}$$

in which:

IIGP refers to the pitch diameter of the internal involute gear pinion,

IIG refers to the pitch diameter of the internal involute gear, a/b designates the additional rotation of the internal involute gear and the rotor on each rotation of the main crank shaft, and $\frac{2}{3}$ is the basic ratio for a rotary engine with a 2-lobed epitrochoidal shaped cavity and a 3-lobed rotor.

The internal involute gear pinion will therefore be rotated by the main crank shaft, via the transmission, such that on each rotation of the main crank shaft the rotor will make an additional rotation a/b in order to obtain to proper shape of the outer envelope of the rotating rotor, which shape is the same as the shape of the 2-lobed epitrochoidal cavity wall.

Figure 4:
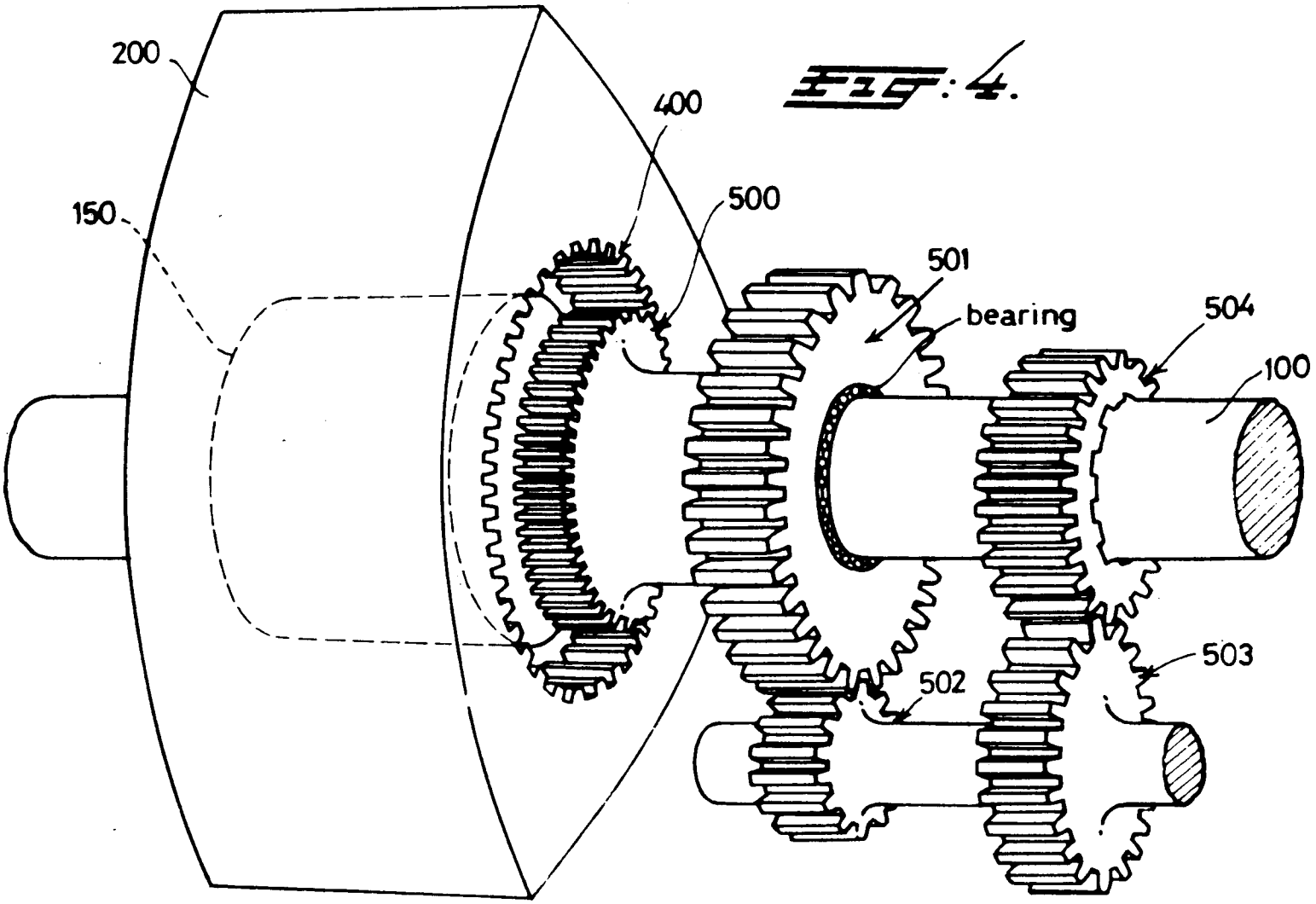
FIG. 4 is a perspective view showing a typical embodiment of the rotary engine according to the invention, in which system the rotor acceleration is done by means of an involute gear system, the direction of the pinion rotation being positive, which means in the same direction as the rotation of the main crank shaft.

If in the above formula a/b is positive, it means that the internal involute gear pinion 500 rotates in the same direction as the main crank shaft 100. This is the case with the transmission shown in FIG. 4.

Figure 5:
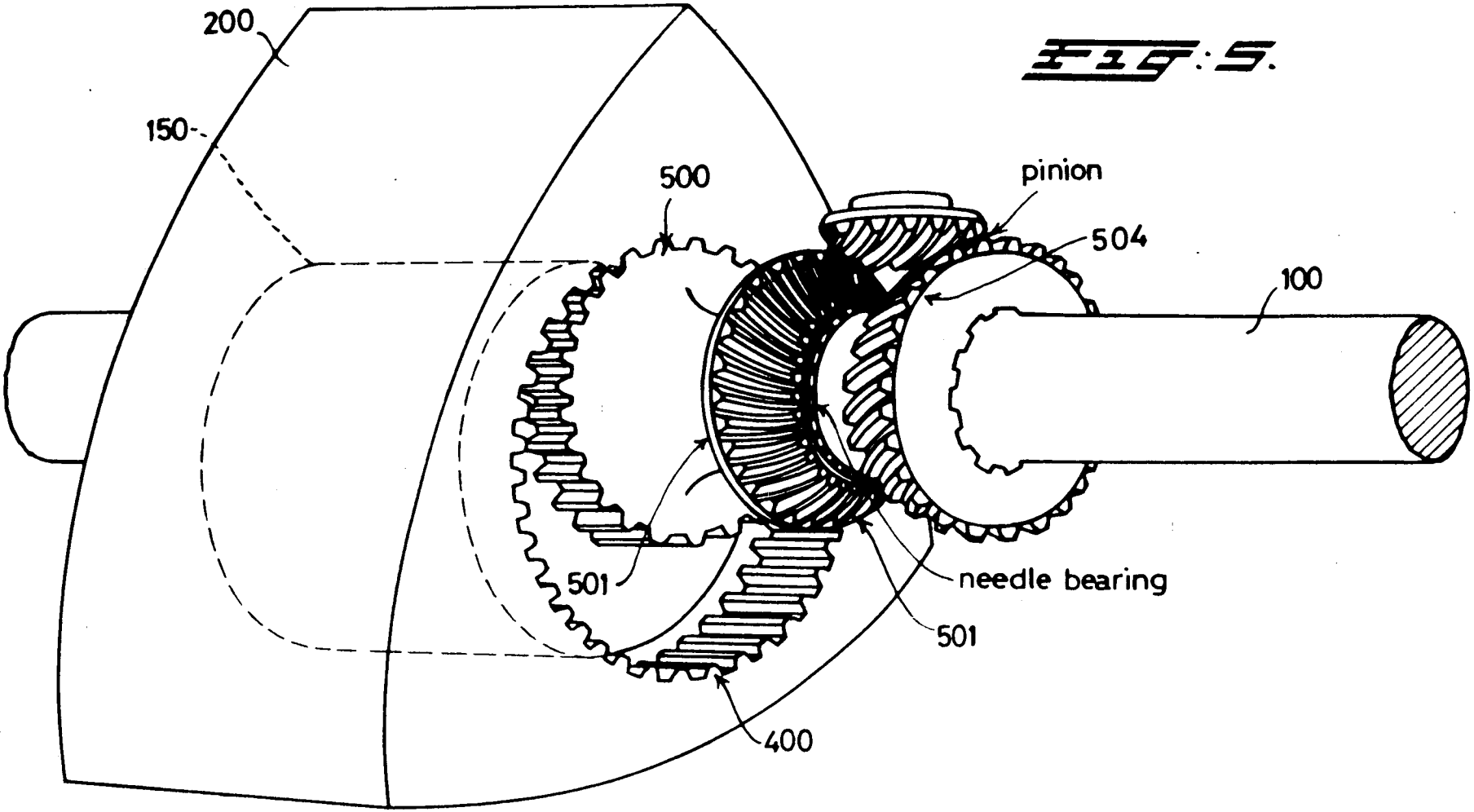
FIG. 5 is a perspective view showing a typical embodiment of the rotary engine according to the invention in which system the rotor deceleration is done by means of a hypoid gear system, the direction of the pinion rotation is negative, which means in a direction opposite to the rotation of the main crank shaft.

However if a/b is negative, it means that the internal involute gear pinion 500 rotates in the opposite direction to the main crank shaft 100. This is the case with the transmission shown in FIG. 5, which transmission comprises a hypoid gear wheel.

If in case of a 2-lobed epitrochoidal shaped cavity the pitch diameter of the internal involute gear pinion divided by the pitch diameter of the internal involute gear is $\frac{2}{3}$, then a/b will become zero which means that the internal involute gear pinion must be fixed to the housing wall. Therefore, the value of IIGP/IIG must differ from $\frac{2}{3}$.

It appears that for a rotary engine with a 2-lobed epitrochoidal shaped cavity and the 3-lobed rotor the optimal value of a/b is 1/12 , which means that on each rotation of the main crank shaft the rotor makes an additional 1/12 rotation. According to the above formula IIGP/IIG will be $\frac{3}{4}$. This means that on each rotation of the main crank shaft the internal involute gear pinion will make a 1/9 rotation, so that the transmission ratio between the main crank shaft and the internal involute gear pinion is 1:9. This transmission ratio can be obtained by two sets of gears, each set having a transmission ratio of 1:3, for example a transmission ratio between the gears 504 and 503 of 1:3 and a transmission ratio between the gears 502 and 501 of 1:3.

The value of 1/12 for a/b is chosen in view of the maximum efficiency of the space available and the minimum gear ratio. The transmission is very simple.

For a rotary engine with an 1-lobed epitrochoidal shaped cavity and the 2-lobed rotor the above formula will be:

$$\frac{IIGP}{IIG} - \frac{a}{b} = \frac{1}{2}$$

The optimal value of a/b will be 1/6 and the transmission ratio between the main crank shaft and the internal involute gear pinion will be 1:4 which transmission ratio can be divided into two equal steps of 1:2.

For a rotary engine with the 3-lobed epitrochoidal shaped cavity and the 4-lobed rotor the above formula is $$\frac{IIGP}{IIG} - \frac{a}{b} = \frac{3}{4}$$

In this case the optimal value of a/b is 1/20 and the transmission ratio of the transmission between the main crank shaft and the internal involute gear pinion will be 1:16, which can be divided in to two equal steps of 1:4.

Figure 6:
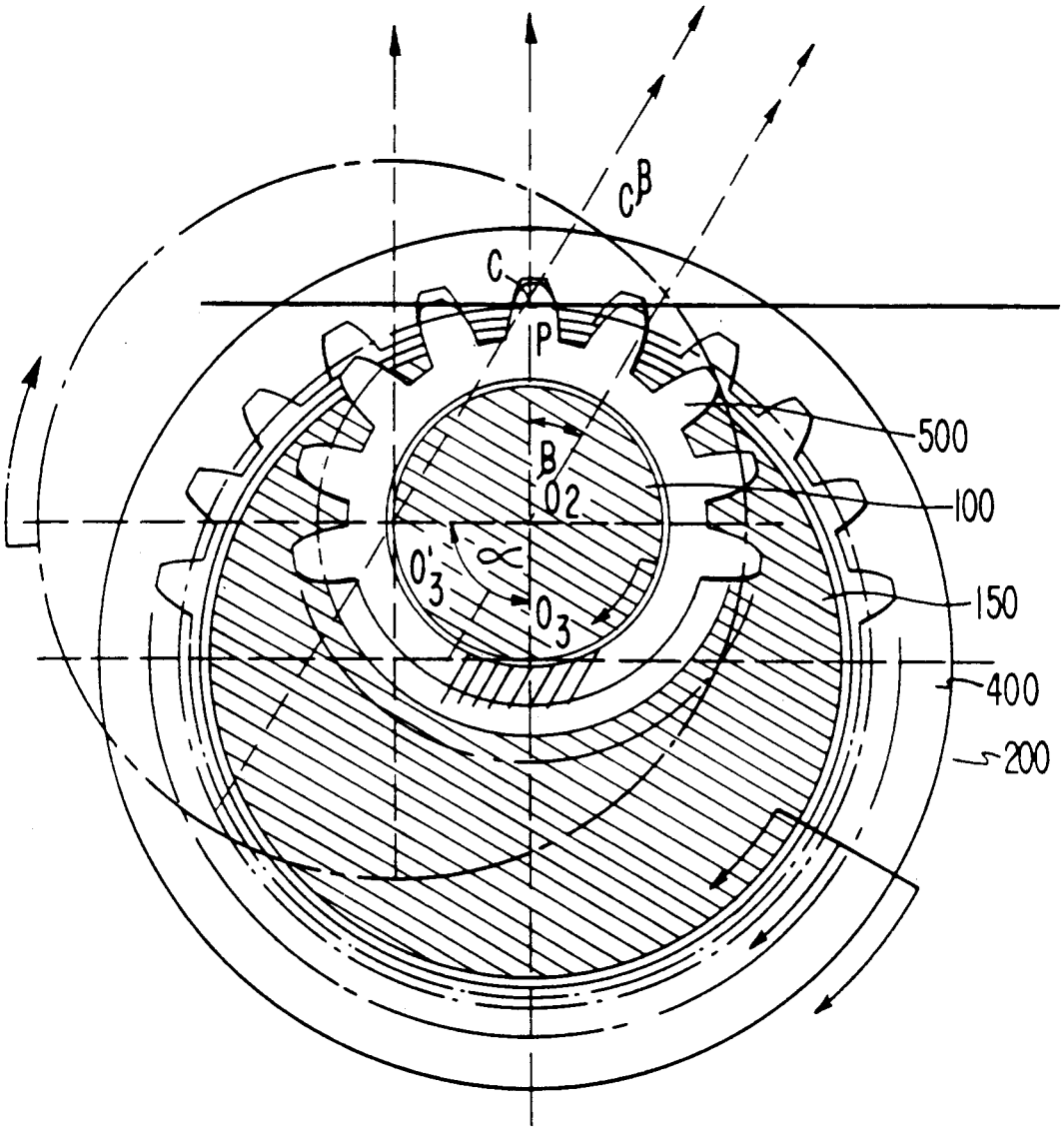
FIGS. 6(*a*), 6(*b*), 6(*c*) and 6(*d*) show the kinematic of the preferred embodiment of the present invention, in which an internal involute gear 400 is fixed to the rotor 200 and intermeshed to an internal involute gear pinion 500 having a hollow shaft, through which a main crank shaft 100 including its integral eccentric hub shaft 150 rotates freely.
Figure 6B:
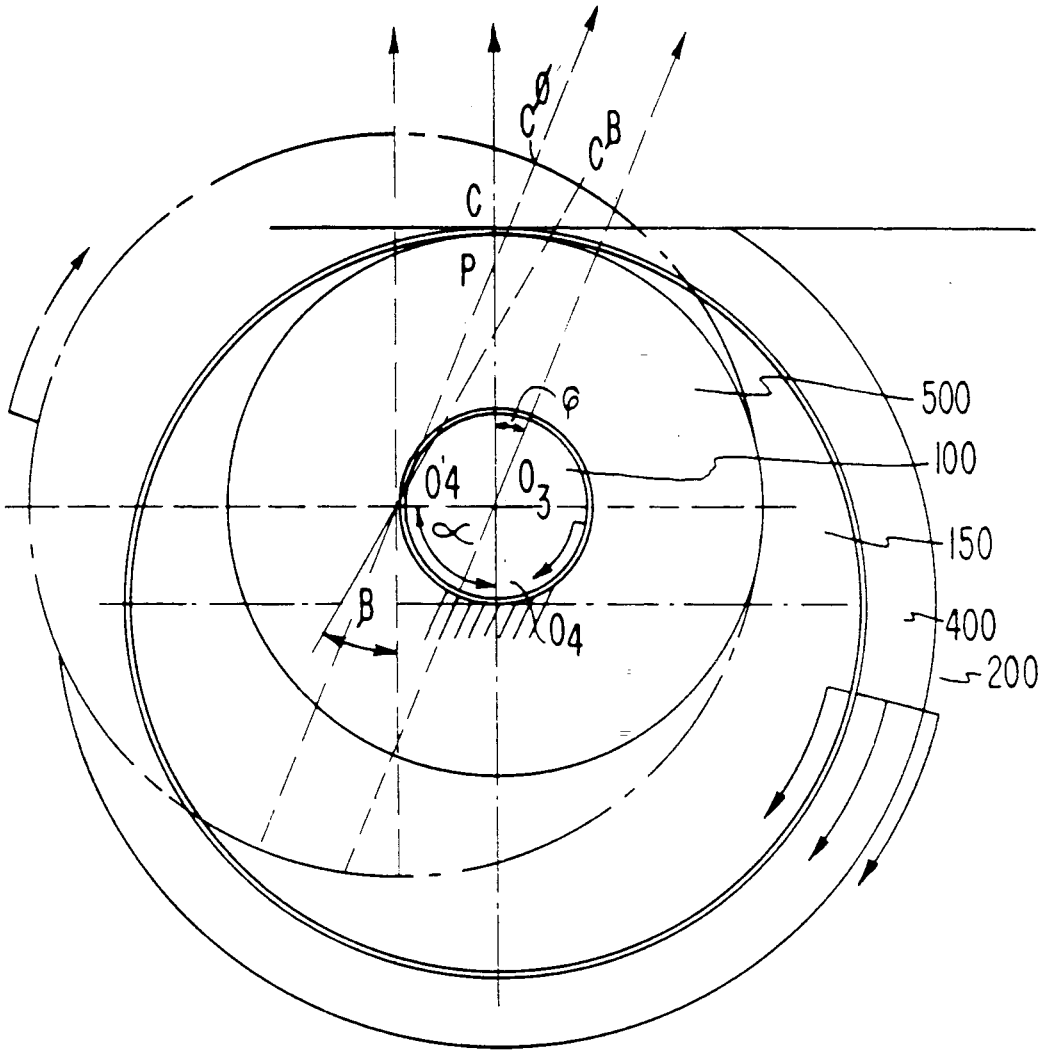
Figure 6:
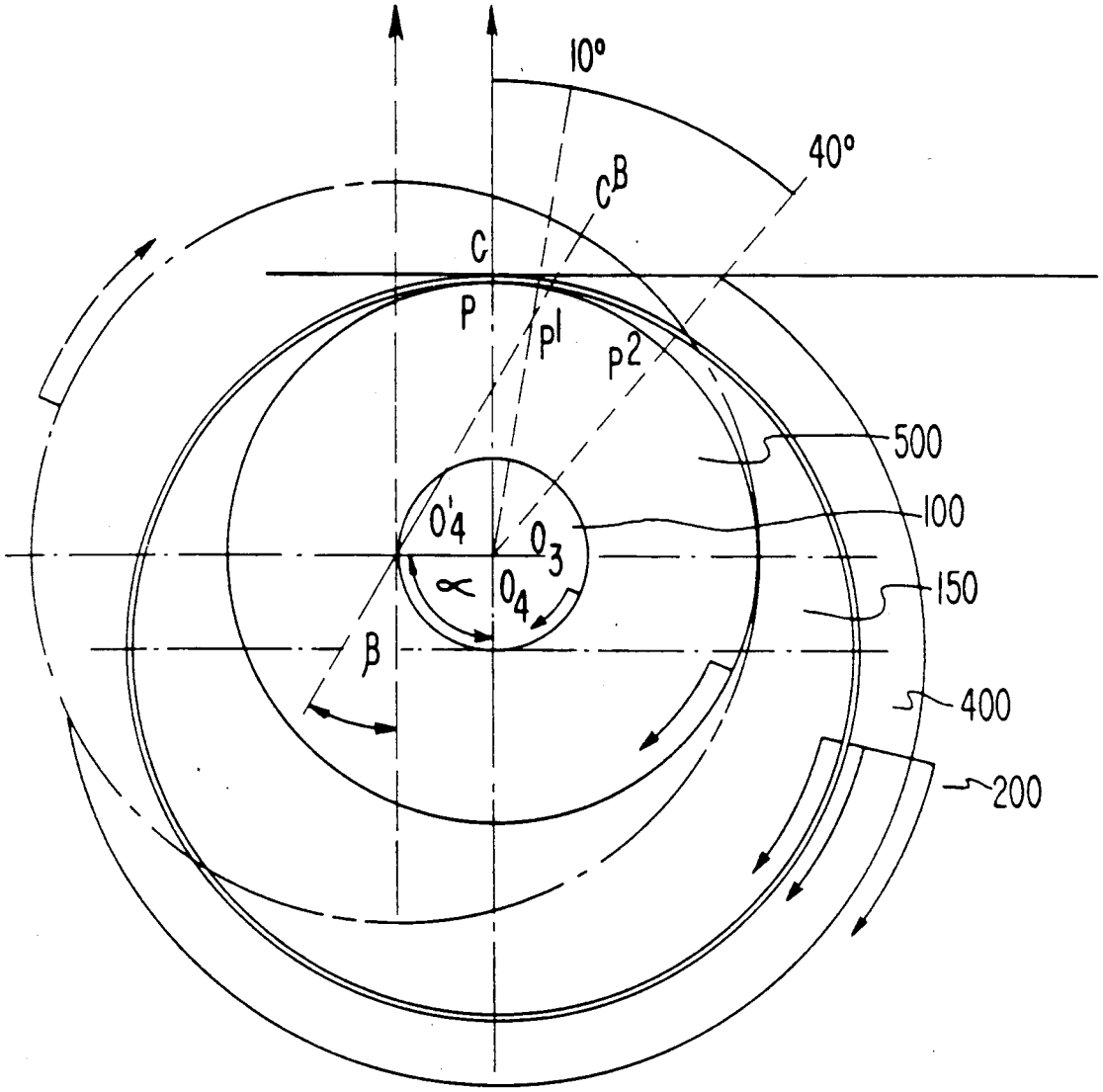
Figure 6D:
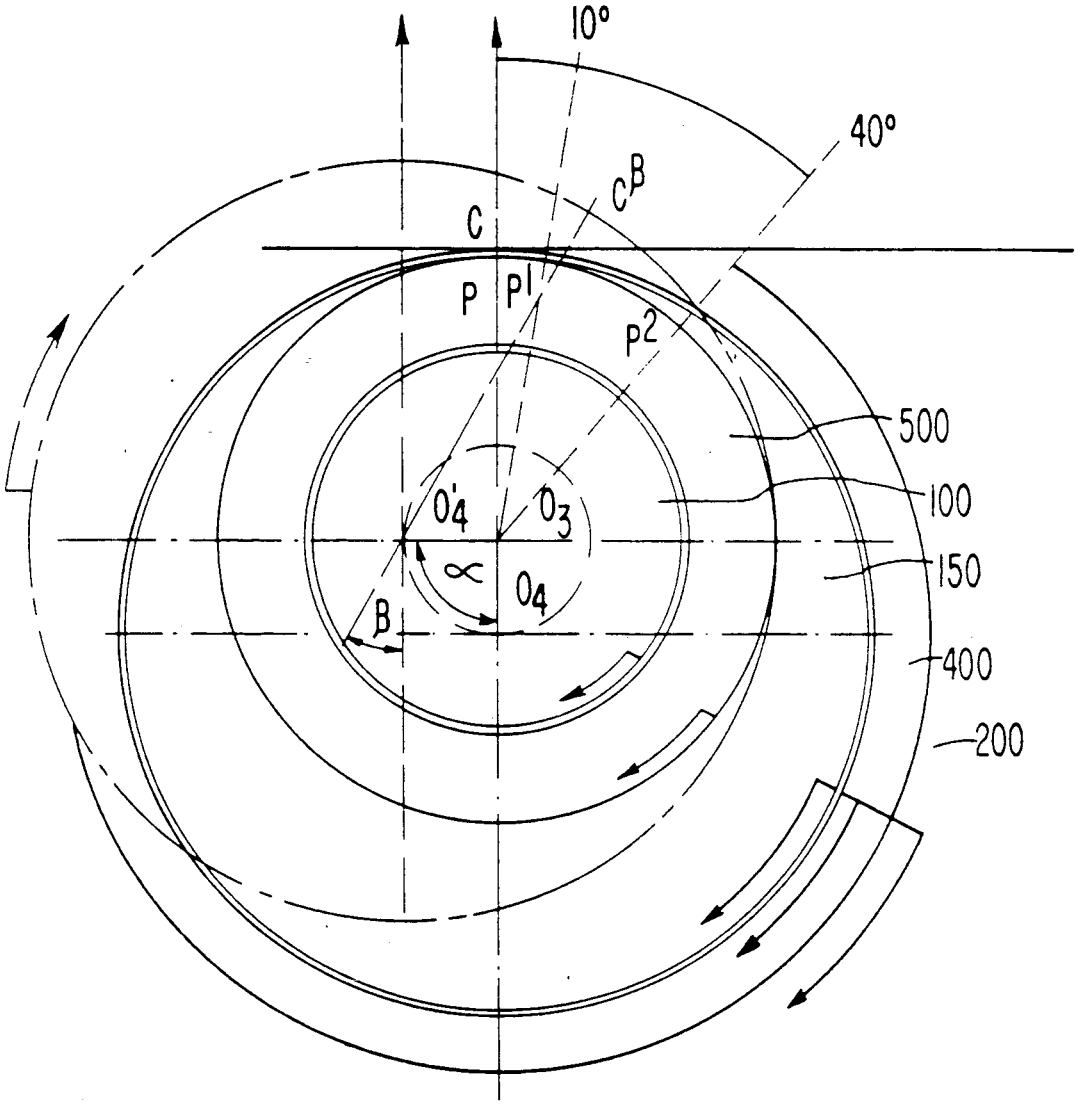

In FIG. 6(*a*), the internal involute gear pinion 500 (hereafter referred to as IIGP 500) is intermeshed with an internal involute gear 400 (hereafter referred to as IIG 400), based on the transmission ratio of 2:3. The IIGP 500 has a hollow shaft through which the main crank shaft 100 (hereafter referred to as MCS 100) can rotate freely.

In such a case, the IIGP 500 is fixed or secured to its housing frame as conventionally constructed.

Based on such transmission ratio of 2:3, every revolution (360°) of the MCS 100 including its integral eccentric hub shaft 150 hereafter referred to as EHS 150), the rotor 200/IIG 400 will be rotated or rotates to $(1\frac{2}{3})\times 360° = 120°$, which means the speed ratio between the rotor 200/IIG 400 against the MCS 100/EHS 150 is 120°:360° = 1:3.

The contact points of both the pitch circles consist of point C which belong to the pitch circle IIG 400 and point P which belongs to the pitch circle IIGP 500.

In FIG. 6(*a*), the MCS 100/EHS 150 is rotated to 90° ($\phi\alpha = 90°$) and therefore the center point 03 of EHS 150 will move to 03[1]. Because the IIGP 500 is stationary, therefore point P will still be at its original position while the point C will move to a new position of $C\beta(\angle\beta = \frac{1}{3}\times\angle\alpha = 30°)$.

In FIG. 6(*b*), IIGP 500 is intermeshed with IIG 400 based on transmission ratio of 3:4, and IIGP 500 is still fixed or secured to its housing frame. By such a transmission ratio of 3:4, therefore every revolution of MCS 100/EHS 150, the rotor 1200/IIG 400 will be rotated or rotates $(1\frac{3}{4})\times 360° = 90°$. Because the MCS 100/EHS 150 is rotated only for 90°, therefore point C will move to point $C\phi$, and point P will maintain its original position ($\angle\phi = \frac{1}{4}\times\angle\alpha = 22.5°$). But because the speed ratio of the rotor 100 must be maintained at 1:3 if using a 3 apex portion rotor with a 2 lobed epitrochoidal housing cavity, therefore the new position of point C must be at the point $C\beta(\angle\beta = 30°)$.

The distance between $C\phi$ and $C\beta$ in this FIG. 6(*b*) can be reached only by the rotor 200/IIG 400 if during the said above rotation it is accelerated through the intermeshing gears installed between the rotor 200 and the MCS 100, therefore the rotor 200 will always be able to reach in due time accurate position of $C\phi$ on each revolution as mentioned above. Such additional dispatch of $C\phi$ to $C\beta$, if mentioned in fractional figures, is designated as a/b in the above mentioned formula.

In FIG. 6(*b*), the distance $C\phi$ to $C\beta$ is $30° - 22.5° = 7.5°$ per 90° of shaft rotation. If calculated by a complete revolution of 360°, said angle will be $(360°:90°)\times 7.5° = 30°$ or represent 1/12 of shaft revolution. In such a case as mentioned in FIG. 6(*b*), the a/b quotient is equal to 1/12 which equation has been used and described in the previous summary of the invention, namely a/b is equal to 1/6, 1/12 and 1/20 respectively. The above mentioned a/b equation is designed for the purpose of maximum use of the space available and minimum gearing to be installed in the engine.

There are so many variations in determining the transmission ratio for such same purpose, but only a few that could save the space and minimum gearing as mentioned above. If the formula is not used to calculate the gearing as explained above, there is the possibility that the a/b quotient cannot be met precisely by any combinations of gears installed, and therefore consequently will not cause the outer envelope of the rotor's rotation shaped exactly to the same of the 2 lobed epitrochoidal housing cavity and be able to maintain the permanent clearance during all relative rotations between each apex portions of the rotor 200 and the housing wall 11. Such permanent clearance is made possible only if the rotor 200 always maintains the speed ratio of 1:3 with MCS 100.

Furthermore the invention is also applicable to any other rotary type such as 2 apex rotor or 4 apex rotor, which for the purpose of simplicity the basic ratio for the specific type of rotary, such as $\frac{1}{2}$ for the 2 apex rotor, $\frac{2}{3}$ for the 3 apex rotor and $\frac{3}{4}$ for the 4 apex rotor, hereinafter will be designated or referred to as p respectively.

The intermeshing gears which are installed between rotor 200/IIG 400 and MCS 100 will cause IIGP 100 to rotate in the same direction in order to be able to let the point $C\phi$ reach the position of point $C\beta$ based on a speed ratio of 1:2 for the 2 apex rotor, or 1:3 for the 3 apex rotor or 3:4 for the 4 apex rotor.

In FIG. 6(*c*), the IIGP 500 is constructed as one hollow shaft with one of the intermeshing gear through which it will be rotated according to its proper speed ratio. Because the a/b quotient of 1/12 represents for such rotary engine with IIGP 500 and IIG 400 having transmission ratio of 3:4, the IIGP 500 will be rotated or rotates to the distance of $1/12\times 4/3\times 360° = 40°$ per full revolution of the MCS 100/EHS 150 or in fractional figure of 1/9. Such fractional figure of 1/9 can be easily splite into $\frac{1}{3}\times\frac{1}{3}$ which means that the further intermeshing gears between the IIGP 500 and MCS 100 is fixed to transmission ratio of 1:3 and 1:3 respectively in order to minimize gears for space efficiency. In FIG. 6(*c*), because the MCS 100 is rotated only for 90°, the new position of the P will be P1 which is $90°/360°\times 40° = 10°$ in the same direction and the actual P position after every full revolution will be P2 which is at 40° away from its original position. In a rotary engine with 2 apex rotor and 1 epicyclic housing cavity, the figure is $\frac{1}{4}$ which can be easily split into fixed transmission ratio of 1:2 and 1:2 respectively while in 3 apex rotor with 4 lobed epitrochoidal housing it will be 1/16 which can be easily split into fixed transmission ratio of 1:4 and 1:4 respectively.

Based on the above transmission ratio of 3:4 between the IIGP 500 and its intermeshing IIG 400, the diameter of the MCS 100 can be constructed larger than the conventional model. Such larger MCS 100 can be seen from the FIG. 6(*d*) by which, naturally, the engine will be able to carry more loads, etc.

In a rotary engine according to the invention the wear of the cavity wall and the rotor will be much less than in an engine without the transmission between the main crank shaft and the rotor, because the rotor is positively guided by the intermeshing gears.

The rotary engine according to the invention can have a various application. As a rotary internal combustion engine it can be applied as a driving motor in a car, a truck, motorbike, train, boat, aircraft, etc.

The rotary engine according to the invention can also be used as a pump or compressor in industrial plants, household equipment, laboratorium equipment and several other types of equipment.

It is noted that the system can also be used for manufacturing the epitrochoidal shaped cavity in a housing. In this case the rotor will be provided with a cutting tool.

What is claimed is:

1. An apparatus equipped with a rotary engine comprising a housing defining a cavity with a n-lobed epitrochoidal shaped wall, a n+1 lobed rotor within said cavity and movable in a planetary fashion, n being 1, 2, 3, . . . and a main crank shaft with an eccentric supporting said rotor, the rotor being provided with an internal involute gear meshing with an internal involute gear pinion rotatably supported by the main crank shaft, the engine further comprising a transmission installed between the rotor and the main crank shaft, the transmission rotation of which is based on the formula $$\frac{IIGP}{IIG} - \frac{a}{b} = P$$

in which

IIGP refers to the pitch diameter of the internal involute gear pinion,

IIG refers to the pitch diameter of the internal involute gear, a/b designates the additional rotation of the internal involute gear on each rotation of the main crank shaft, and p is the basic ratio for the specific type of rotary engine, being equal to $\frac{1}{2}$, $\frac{2}{3}$, $\frac{3}{4}$, . . . for a 1-, 2-, 3-, . . . respectively lobed epitrochoidal shaped cavity wall, such that during rotation of the rotor the shape of the outer envelope of the rotating rotor is exactly the same as the shape of the wall of the cavity and wherein when n is one a/b is 1/6, when n is two a/b is 1/12 and when n is three a/b is 1/20.

2. A rotary engine, such as a rotary internal combustion engine, a rotary pump, a rotary compressor, comprising a housing defining a cavity in the form of a two lobed epitrochoidal wall, a three lobed rotor within said cavity and movable in a planetary fashion, and a main crank shaft with an eccentric supporting said rotor, the rotor being provided with an internal involute gear meshing with an internal involute gear pinion rotatably supported by the main crank shaft and further comprising a transmission installed between the rotor and the main crank shaft, the transmission ratio of which is based on the formula $$\frac{IIGP}{IIG} - \frac{a}{b} = \frac{2}{3}$$

in which:

IIGP refers to the pitch diameter of the internal involute gear pinion,

IIG refers to the pitch diameter of the internal involute gear, a/b designates the additional rotation of the internal involute gear on each rotation of the main crank shaft and is equal to 1/12, and $\frac{2}{3}$ is the basic eccentric ratio for the specific type of rotary engine.

3. The rotary engine according to claim 2 wherein the transmission ratio between the main crank shaft and the internal involute gear pinion is 9:1, which ratio is divided into two equal steps of $\frac{1}{3}$ and $\frac{1}{3}$, respectively, for minimum gears and maximum space efficiency.

4. The rotary engine according to claim 2, wherein a proper clearance is permanently maintained between the rotor and the wall of the cavity for the purpose of installing a sealing system.

* * * * *